United States Patent [19]

Miller et al.

[11] 3,961,157

[45] June 1, 1976

[54] ELECTRICAL RADIANT HEATER PANEL

[75] Inventors: Robert C. Miller, Madison; Barrie H. Hackett, Haddam Neck, both of Conn.

[73] Assignee: Safeway Products Inc., Middletown, Conn.

[22] Filed: Jan. 6, 1975

[21] Appl. No.: 538,642

[52] U.S. Cl. ..... 219/345; 219/213; 219/355; 219/358; 219/531; 219/548; 428/118

[51] Int. Cl.[2] ..... H05B 3/28; F24H 9/00; B32B 3/12

[58] Field of Search ..... 219/345, 342, 213, 548, 219/358, 355, 531; 165/49; 161/68; 428/118

[56] References Cited

UNITED STATES PATENTS

| | | | |
|---|---|---|---|
| 2,001,632 | 5/1935 | Schlichting | 161/68 |
| 2,512,875 | 6/1950 | Reynolds | 219/345 |
| 2,540,295 | 2/1951 | Schreiber | 219/345 |
| 2,556,470 | 6/1951 | Del Mar | 161/68 |
| 2,634,361 | 4/1953 | Reynolds | 219/345 |
| 2,799,764 | 7/1957 | Chandler | 219/345 |
| 3,020,379 | 2/1962 | Ludlow et al. | 219/345 |
| 3,043,943 | 7/1962 | Moot | 219/345 UX |
| 3,309,500 | 3/1967 | Reynolds | 219/345 |
| 3,513,296 | 5/1970 | Brangs et al. | 219/345 X |
| 3,612,823 | 10/1971 | Ellison | 219/345 |

FOREIGN PATENTS OR APPLICATIONS

| | | | |
|---|---|---|---|
| 465,842 | 6/1950 | Canada | 219/345 |
| 812,919 | 5/1969 | Canada | 219/213 |
| 1,188,237 | 3/1959 | France | 219/345 |

*Primary Examiner*—A. Bartis

[57] ABSTRACT

A radiant heater of panel form comprises an electric resistance heater sandwiched between a non-conductive flat front panel and a thermal insulator in the form of an open-celled honeycomb panel having closed front and rear faces. An electrically non-conductive rear panel is bonded to the rear face of the honeycomb panel. The front panel is selected for maximum emission at temperatures below 200°F. The interior of the rear face of the honeycomb panel is provided with a heat reflecting metallic foil layer which acts as a directional heat reflector. The over temperature protection device for the panel heater is positioned entirely within the honeycomb panel between the front and rear faces thereof.

3 Claims, 4 Drawing Figures

THERMOSTAT
THERMOSTAT

ELECTRICAL RADIANT HEATER PANEL

BACKGROUND OF THE INVENTION

1. Field of the Invention

The present invention relates to heating apparatus and particularly to heating apparatus for enhancing comfort by raising the temperature in localized areas. More specifically, this invention is directed to electrical heaters and particularly to electrical heaters capable of warming localized areas by radiation. Accordingly, the general objects of the present invention are to provide novel and improved articles of such character.

2. Description of the Prior Art

Portable electric heaters are well known in the art. The prior art portable electrical heaters, for example the well known varieties of space heater, are characterized by a relatively high thermal output, high temperature at or near the surface of the heating element or elements, bulky size and less than attractive appearance; most prior art heaters having exposed heating elements and a reflector. The size, thermal output available and high surface temperature, considering for example the environment of an office, has generally resulted in the prior art heaters being positioned in traffic areas or balanced in rather precarious locations when used. This necessary placement has, in turn, produced accidents and has been exceedingly wasteful of power. Additionally, prior electrical heaters of the portable or space variety are known to be very inefficient. This lack of efficiency may, to a large extent, be attributed to convection losses to the ambient air at or adjacent to the emitting face of the heaters.

It is well known that, if the legs and feets of an individual can be kept warm, such person's general comfort and efficiency will not be adversely affected by being in a relatively cool ambient environment. This is particularly true of individuals with a comparatively sedentary occupation which requires they perform their work functions at a desk. At the present time there are no efficient portable heaters available which are suitable to installation, by way of example, under a desk. However, keeping areas such as the space beneath a desk warm becomes increasingly important as thermostats are lowered to conserve fuel.

SUMMARY OF THE INVENTION

The present invention overcomes the above briefly discussed and other deficiencies and disadvantages of the prior art by providing a novel and improved radiant electrical heater. A heater in accordance with the present invention is characterized by its ability to be produced in the form of lightweight thin panels which may, if desired, be mounted on the inside of the front panel (sometimes referred to as the modesty panel) of a desk.

A radiant heater in accordance with the present invention is characterized by a lightweight frame, typically metallic, which defines a channel for supporting heating elements, controls and a reflector. In a preferred embodiment the present invention employs a heating element, consisting of a continuous length of resistance wire mountd on a circuit board so as to define, in effect, a plurality of heat sources on a first surface of the board. The heating element is positioned within the frame and behind a front panel comprised of a plastic material which radiates long wavelength thermal radiation; the panel material being selected for maximum emissivity. The heating element transmits heat by conductance to the emitting face of the panel.

A radiant heater in accordance with the present invention further comprises, positioned within the frame and behind the heater element, a honeycomb structure comprised of lightweight fire retardant material. This honeycomb structure imparts structural strength to the heater and defines a space which receive the controls; i.e., a thermostat and fuse for the heater. The honeycomb structure, at the side disposed away from but facing the heating element, includes a reflective surface as an integral part of the honeycomb unit. This reflective surface, in conjunction with the segmented insulation defined by the honeycomb structure, provides a directional radiant heat reflector; the honeycomb structure providing a free and open air path directly to the radiation reflector and restricting free thermal convection within the panel. Accordingly, heat radiated rearwardly from the heating element is returned to the front emissive panel with a high degree of efficiency, and objects on which the radiant warmer are mounted will not become excessively heated. The radiant heater also comprises a back panel, comprised of a suitable composite plastic material, positioned to the outside of the honeycomb structure.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE PREFERRED EMBODIMENT

Figures 1, 2, 3, 4:
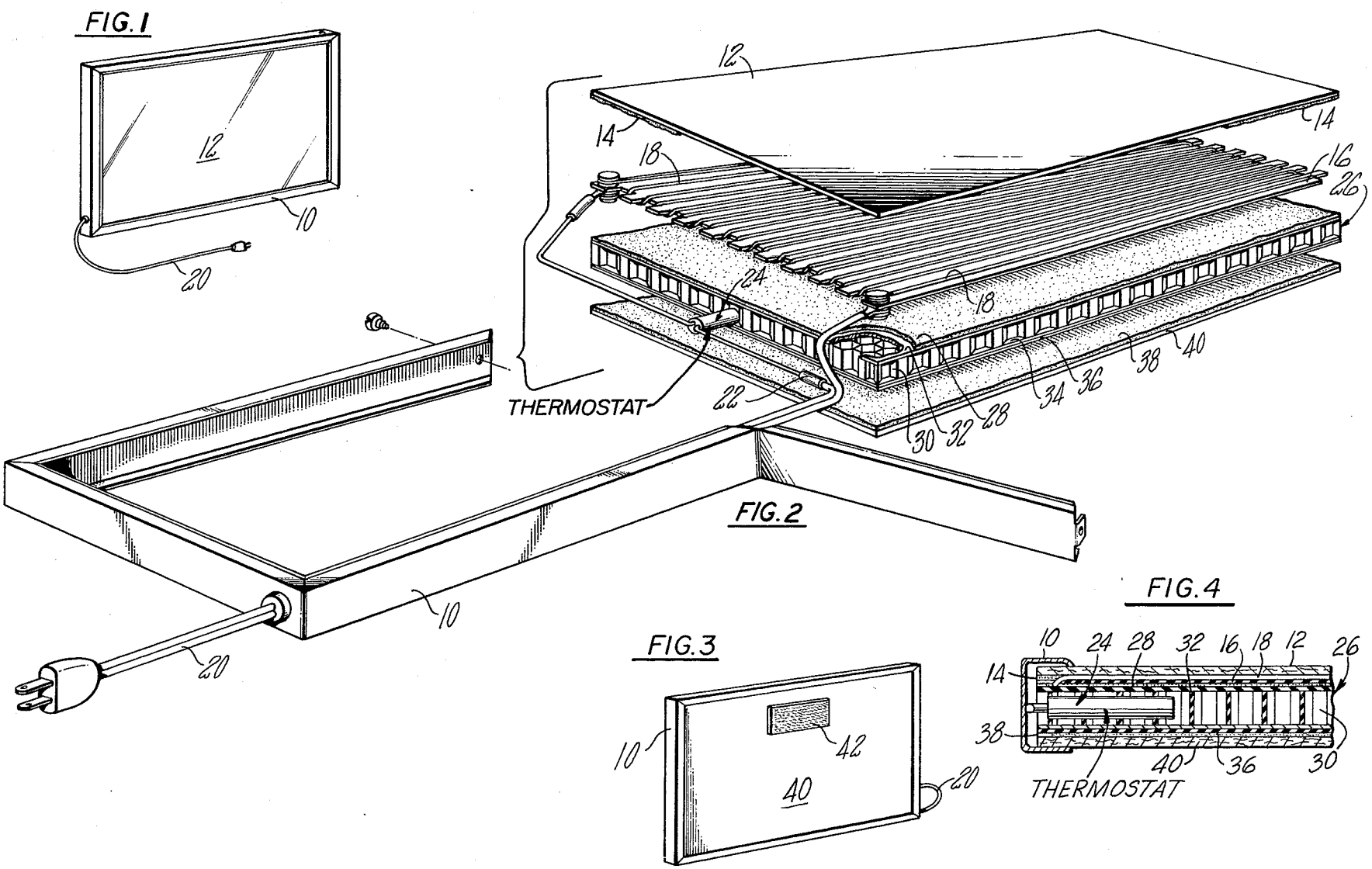
FIG. 1 is a front perspective view of a radiant heater in accordance with a first embodiment of the present invention.
FIG. 2 is an exploded perspective view, partly in section on an enlarged scale, of the apparatus of FIG. 1.
FIG. 3 is a rear perspective view of the heater of FIG. 1.
FIG. 4 is a partial cross-sectional view of the heater of FIG. 1 depicting placement of the temperature sensing element therein.

With reference jointly to FIGS. 1 to 4, a radiant heater in the form of a thin, lightweight rectangular panel is depicted. The exterior dimensions of the heater are defined by a frame 10 which will typically be comprised of stainless steel or aluminum. Mounted within frame 10, at the heat emitting or front side of the device, is a smooth front panel member 12. Panel 12 will be comprised of an electrically non-conductive plastic laminate such as, for example, the material commonly known as FORMICA. The material and surface finish of panel 12 are selected, as will be further discussed below, so as to achieve a high value of heat emissivity.

A heating element is positioned within frame 10 directly behind panel 12; the heating element being bonded to the rear side of panel 12 by a layer of adhesive 14. The heating element comprises a circuit board 16 provided, at its oppositely disposed edges, with a series of tooth defining notches. As can be seen from FIG. 2, a continuous length of resistance wire 18 is arranged on circuit board 16 so as to define, in effect, a plurality of parallel heat sources. The wire 18 thus extends from a first terminal post along the length of circuit board 16 on a first side of the board, loops under one of the teeth or serrations and then returns parallelly along the first side of the board to the opposite end of the circuit board; this winding arrangement repeating until the resistance wire reaches a second terminal oppositely disposed from the first terminal at the same edge of board 16 as the first terminal. A first conductor of a line cord 20 is directly connected to a first of the terminals on circuit board 16 and is thus electrically connected to a first end of resistance wire 18. The second conductor of line cord 20 is connected through a connector 22, to a thermostat subassembly 24 which is inserted in the electrical circuit between connector 22 and the second end of wire 18 at the second terminal on circuit board 16. The thermostat subassembly 24 will be discussed in greater detail below.

A honeycomb panel subassembly, indicated generally at 26, is positioned within frame 10 directly behind the heater element circuit board 16. Honeycomb panel subassembly 26 is made up of upper and lower sheets with honeycomb subassembly cells therebetween. The honeycomb panel 26 is bonded to board 16 by means of a suitable adhesive 28. The honeycomb panel subassembly 26 is fabricated from a flame retardent paper; the honeycomb cell defining structure 30 and the front cover sheet 32 both being commercially available treated kraft paper. The rear sheet of honeycomb panel subassembly 26 consists of a laminate comprising an inner sheet 34 of aluminum foil and an outer or base sheet 36 of flame retardant kraft paper. Aluminum foil sheet 34 presents a reflective surface to heat radiated toward the rear side of th honeycomb panel subassembly from the heating element. The honeycomb panel subassembly of front sheet 32, cell structure 30 and rear laminate sheet 34, 36 is an integral unit.

The radiant heater of the present invention is, in the disclosed embodiment, completed by a rear panel 40 which is bonded, by means of a layer of adhesive 38, to the exposed side of kraft paper layer 36 of honeycomb panel subassembly 26. Rear panel 40 is comprised of a composite plastic material such as, for example, MASONITE. As may be seen from FIG. 3, the exposed surface of panel 40 may be provided with suitable means whereby the entire radiant heater may be hung from a wall or from the inside front panel (modesty panel) of a desk. In FIG. 3 the hanger means is depicted as a pad 42 of double faced adhesive, or it may be VELCRO fasteners. In one particularly attractive application the device is attached, by VELCRO fasteners, to the inside front panel in the leg well of a desk. The heater then serves to heat the legs and feet of the user of the desk, thereby providing a significant amount of personal comfort nothwithstanding a lower than normal ambient temperature.

In a preferred embodiment thermostat subassembly 24 consists of a series connected thermostat and a thermal fuse. The subassembly 24 is inserted in a hole provided therefore in the honeycomb panel subassembly 26 so as to be positioned to accurately sense the temperature adjacent the heater element. The thermostat provides a cyclic over-temperature protection while the thermal fuse provides a one time maximum thermal overload protection.

The operation of the radiant heater of the present invention will now be briefly discussed. The apparatus is designed and materials selected so as to utilize, to the extent possible, basic principles of radiant heat transfer as applicable to low temperatures and relatively long electromagnetic wavelengths. In contrast to prior art space-type heaters, the present invention employs an electrically non-conductive material (front panel 12) as the thermal radiator. Non-electrical conductive surfaces are, in general, better energy emitters at lower temperatures; i.e., at temperatures less than 200°F. Additionally, emissivity values of such electrical non-conductors increase with increasing wavelength. Further, such non-conductors emit greater radiation at angles normal to the surface and are therefore directional. Thus, in the practice of the present invention the components are selected so as to produce, at the face of panel 12, surface temperatures which permit the panel 12 to radiate at its maximum emissivity; these temperatures being below 200°F and generally in the range of from 150°F to 180°F. The present invention operates in the relatively long wavelength portion of the thermal energy wavelength spectrum; i.e., in the infrared range. Operation in this long wavelength range, coupled with the low temperature and flat emitting surface of panel 12, minimizes convection losses to the ambient air and thus enhances the heating efficiency of the invention.

The heating element; i.e., the circuit board 16 and resistance wire 18, transmits heat by conductance to the emitting face of panel 12. As previously noted, the material selected for panel 12 and the surface finish of this panel are selected so as to produce a high value of emissivity. Accordingly, because the panel of the present invention operates in the low temperature, long wavelength range of thermal energy radiation, and further because panel 12 is comprised of an electrically non-conductive material with a flat surface, high emission efficiency is obtained and the color of panel 12 can be selected as desired to obtain a decorative appearance without any serious effect on efficiency.

Continuing with a discussion of the operational features of the present invention, the reflective surface provided at the rearwardly disposed inner side of honeycomb panel subassembly 26 by aluminum foil 34, in cooperation with the segmented insulation defined by the honeycomb cells, defines a combined insulator and directional radiant heat reflector. As is characteristic of all electrical conductors, the emissivity of aluminum decreases and reflectivity increases with increasing wavelength; i.e., poor heat emitters are good heat reflectors. Also, electrical conductors are characterized by higher reflectivity as the angle of impingement of thermal radiation becomes more perpendicular. In addition, as the temperature of the source of thermal radiation increases, the absorptivity of an adjacent electrically conductive surface increases, and thus foil 34 is more reflective, at the lower radiation temperature at which this invention operates. Taking all of these factors into account it may be seen that the aluminum reflective surface 34 within honeycomb panel subassembly 26 approaches its maximum reflectivity at the relatively low radiation temperatures of the heater of the present invention.

The honeycomb panel subassembly 26, by virtue of its open cell structure, defines an essentially free and open air path between the reflector 34 and the rear surface of the heater. The honeycomb structure, additionally, restricts free thermal convection within the panel. Thus, the honeycomb panel subassembly 26, by virtue of the material and cell size selected, imparts structural rigidity to the invention while permitting the production of a lightweight device with minimal internal thermal losses. With further regard to thermal losses, the division of the free air space within the apparatus into small cells reduces the potential velocity of free air circulation. The mixing motion of the air within the heater is thereby reduced and the effectiveness of heat transfer by convection is lowered, thus minimizing heat losses behind radiant surface 12.

In one reduction to practice of the invention the overall dimensions of the heater were about 22-½ inches wide, about 16 inches high, about 1 inch in thickness and approximately 5 pounds in weight. While a rectangular panel has been shown it will, of course, be understood that the radiant warmer of the present invention can be produced in any desired shape.

While a preferred embodiment has been shown and described, various modifications and substitutions may be made thereto without departing from the spirit and scope of the invention. Accordingly, it is to be understood that the present invention has been described, by way of illustration and not limitation.

What is claimed is:

1. A radiant heater comprising:

a planar front panel formed of an electrically non-conductive material, said front panel having a first radiation emitting surface and a second interior surface;

heating element means adhesively bonded to said second surface of said front panel, said heating element means including a resistance heater, thermal energy radiated by said resistance heater being transferred to said front panel by conductance;

heat reflector means adhesively bonded to said heating element means on the opposite side of said heating element means from said front panel, said heat reflector means being an integral unit comprised of:

a first planar layer of electrically non-conductive flame retardant material, said first layer being disposed adjacent to said heating element means and being oriented parallel to the plane of said front panel;

a honeycomb cell defining member, said cell defining member being formed from an electrically non-conductive flame retardant material, a first forwardly facing side of said cell defining member being bonded to the rearwardly facing side of said reflector means first layer whereby open cells of said member are exposed to and oriented generally perpendicular to said first layer; and a planar laminate including a layer of electrically conductive material and a layer of electrically non-conductive flame retardant material, said laminate being positioned at the rearwardly disposed side of said honeycomb cell defining member, said layer of electrically conductive material of said laminate facing and being exposed to the interior of the honeycomb cells whereby heat radiated rearwardly from said heating element means will be incident on said layer of conductive material in a substantially perpendicular direction, the material and surface characteristics of said electrically conductive layer being selected to provide a high degree of reflectivity of the incident thermal radiation;

a rear panel comprised of an electrically non-conductive material, said rear panel being bonded to the layer of electrically non-conductive material of said heat reflector means planar laminate; and over temperature protection means for said heater, said protection means including a temperature sensitive element connected in series with said heating element means resistance heater, said protection means being positioned entirely within said honeycomb cell defining member between said first and electrically conductive layers of said heat reflector means, said protection means being spaced from said electrically conductive layer and being separated from said heating element means only by said first layer of non-conductive material.

2. The radiant heater of claim 1 wherein said front panel consists of a plastic material having a flat emitting surface, the plastic material comprising said front panel being selected for maximum emissivity of infrared radiation in the temperature range of 150° to 200°F.

3. The radiant heater of claim 2 wherein said electrically conductive layer of said heat reflector means comprises an aluminum foil.

* * * * *